United States Patent [19]

Morimoto et al.

4,114,351

[45] Sep. 19, 1978

[54] ENCASING APPARATUS

[75] Inventors: Toshiki Morimoto, Kawasaki; Sumisaburo Hori, Akishima, both of Japan

[73] Assignee: Mitsui Mining & Smelting Co., Ltd., Tokyo, Japan

[21] Appl. No.: 791,864

[22] Filed: Apr. 28, 1977

[51] Int. Cl.[2] ..... B65B 5/10; B65B 35/56

[52] U.S. Cl. ..... 53/157; 53/537; 198/409; 198/412; 198/431

[58] Field of Search ..... 53/26, 142, 148, 157, 53/156, 161, 162, 164, 165, 236; 193/44; 198/406, 409, 412, 418, 431; 214/6 M

[56] References Cited

U.S. PATENT DOCUMENTS

| | | | |
|---|---|---|---|
| 2,850,142 | 9/1958 | Engleson et al. | 198/412 |
| 3,431,698 | 3/1969 | Bathellier | 53/165 X |

*Primary Examiner*—Robert Louis Spruill
*Attorney, Agent, or Firm*—Flynn & Frishauf

[57] ABSTRACT

The encasing apparatus of this invention comprises a feed mechanism, a turnabout mechanism, and a slide mechanism, and may be additionally provided with a partition sheet feeder depending upon the type of articles to be packed. The turnabout mechanism receives articles delivered from the feed mechanism with a tray, allows each prescribed number of such articles to line up successively in a first direction of the tray so that the articles lie in the same direction, and, after turning the tray around a vertical shaft through a fixed angle, inclines the tray to move the articles in a second direction at an angle of 90° to the first direction, thereby delivering the articles to the slide mechanism. Subsequently, the slide mechanism lines up the articles so as to true up the ends of the articles in the second direction, and then introduces them regularly into the packing box. In putting the articles in layers in the packing box, a partition sheet may be interposed between each two adjacent layers by additionally employing a partition sheet feeder.

15 Claims, 4 Drawing Figures

ENCASING APPARATUS

BACKGROUND OF THE INVENTION

This invention relates to an encasing apparatus for putting products to be packed or articles in a packing box automatically in an orderly manner.

There have conventionally been used a variety of encasing apparatuses. However, in encasing articles produced in manufacturing apparatuses with these conventional encasing apparatuses, a conveyor or chute has generally been coupled to the manufacturing apparatus so as to deliver articles produced in order by means of such conveyor or chute and to introduce such articles into a packing box standing by at the forward end of the conveyor or chute. Though these apparatuses may be suitably used for loading the packing box with products in bulk, they are unsuitable for the case in which the articles are required to be put in the packing box in an orderly manner.

Where vacuum means is applied for aligning the articles, there occurs the following drawbacks. The first drawback is that the apparatus comes to be a complicated structure. The second drawback is that the application is limited to a narrow range of articles, since the article is required to have a gently-sloping surface to be attracted by the action of vacuum. The third drawback is that time for renewing the arrangement of the apparatus is long and expensive when the type of article to be handled is changed.

SUMMARY OF THE INVENTION

An object of this invention is to provide an encasing apparatus free from the aforesaid defects possessed by the conventional apparatuses and capable of putting articles in packing boxes automatically in an orderly manner.

In order to attain the above-mentioned object, the encasing apparatus of this invention comprises a feed mechanism to feed articles; a turnabout mechanism located on the forward end side in the feed direction of the feed mechanism for making a first alignment by locating a prescribed number of the articles successively in layers in the feed direction thereof or a first direction and for delivering such articles, kept subject to said first alignment, in a second direction perpendicular to the first direction after turning the articles around a vertical rotary shaft through a fixed angle; and a slide mechanism for making a second alignment to true up the ends of the articles in the second direction of the articles delivered from the turnabout mechanism by supporting the articles at such ends thereof and then delivering these articles in the second direction into a packing box.

In the encasing apparatus of this invention, the first and second alignments are achieved in the turnabout mechanism and the slide mechanism respectively, and a prescribed number of articles lined up in good order are fed into the packing box, so that the articles may be introduced into the packing box regularly. Both such alignments, as well as feed to the packing box, are performed automatically by mechanical systems without requiring manual operation, which contributes substantially to improvement of operation efficiency and reduction of cost. Further, if the whole of the machine including these processes is automated, such improvements will become even greater.

If the articles to be handled by the encasing apparatus of this invention are of a type susceptible to damage, when putting them in layers in the packing box, it is recommended to interpose a partition sheet such as corrugated cardboard between each two adjacent layers of articles. In this case, there should preferably be provided a partition sheet feeder for supplying such partition sheets between the layers of articles.

In a preferred embodiment of this invention, the turnabout mechanism is so formed as to include a tray having a rising wall along at least one edge and attached inclinably to the tip end of a vertical rotary shaft so as to turn with the rotary shaft, means for inclining the tray, and means for driving the rotary shaft. With the turnabout mechanism formed in this manner, the delivered articles may be so supported by the rising wall as to secure the first alignment, while such articles may be slid down the tray in a direction turned through an angle of 90° into the slide mechanism owing to the rotatability and inclinability of the tray.

Further, in a preferred embodiment of this invention, the slide mechanism is so formed as to include an inclinable sliding tray mounted to receive articles delivered from the turnabout mechanism at one end of the sliding tray. The articles slide down toward the other end side of the sliding tray due to its inclination. The sliding tray has an outlet to deliver the articles at said other end side and a shutter to open and close the delivery opening, said other end side of the sliding tray functioning for making the second alignment of the articles when the shutter is closed and for delivering the articles after the second alignment through the outlet when the shutter is opened. Further provided is means for inclining the sliding tray. The slide mechanism with such construction enables a relatively simple mechanism to perform the second alignment of the articles to be delivered into the packing box.

DETAILED DESCRIPTION OF THE PREFERRED EMBODIMENT

Figure 1:
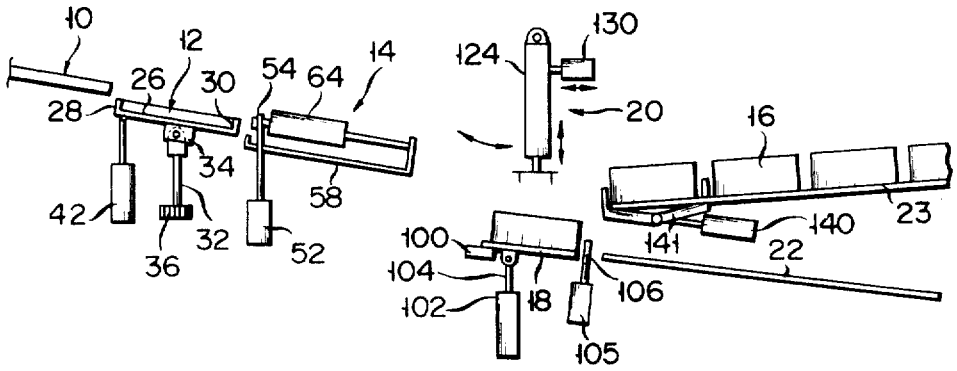
FIG. 1 is a side view of the apparatus of this invention illustrating the outline of the overall arrangement and construction.

FIG. 1 shows a lateral outline of the arrangement of the encasing apparatus illustrating the principal mechanisms including a feed mechanism 10 to receive articles and deliver them to the next stage, a turnabout mechanism 12, a slide mechanism 14, a packing box 16, a packing box receiver 18, a partition sheet feeder 20, and a packing box delivery mechanism 22.

Figure 2:
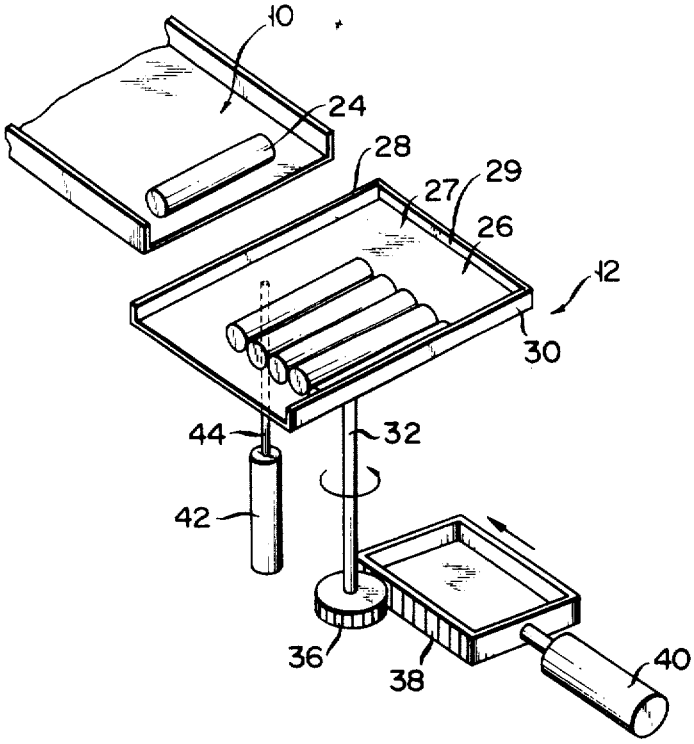
FIG. 2 is a perspective view of the turnabout mechanism.

As partly shown in FIG. 2, the article feed mechanism 10 may be, for example, a belt conveyor, roller conveyor, or chute which operates in cooperation with a manufacturing apparatus (not shown). Products or articles manufactured in the manufacturing apparatus are fed one by one to the turnabout mechanism 12 by the feed mechanism 10. In FIG. 1, as well as in others, the housing of the encasing apparatus to which the above mechanisms are mounted is omitted for simplicity.

The turnabout mechanism 12 as shown in FIG. 2 receives articles 24 from the feed mechanism 10, makes a first alignment of such articles 24 as mentioned hereinafter, and delivers them to the slide mechanism 14. In this embodiment, the articles 24 are somewhat long round bars, which roll down the feed mechanism 10 and are delivered onto a tray 26 of the turnabout mechanism 12. The tray 26 comprises a square plate 27 and rising walls 28, 29 and 30 provided on three sides of the square plate. On one side of the square plate from which the articles are delivered after rotation of the square plate 27, there is provided no rising wall. Among the three rising walls 28, 29, 30, the rising wall 28 is erected lower than the other rising walls.

A rotary shaft 32 is coupled to the central portion of the bottom surface of the tray 26 through a universal coupling 34 (FIG. 1), while a pinion 36 is attached to the lower end of the rotary shaft 32. The pinion 36 is engaged with a rack 38, which is driven by a pneumatic cylinder 40. Therefore, when the pneumatic cylinder 40 is operated, the tray 26 is turned. Under the tray 26 is provided an inclining pneumatic cylinder 42. When this cylinder 42 is operated to move a piston 44 upward, one end of the tray 26 on the feed mechanism 10 side is forced up and the tray 26 is turned clockwise as in FIG. 1 for inclining the tray 26 to slide the articles 24 towards the rising wall 30; when the piston 44 is moved downward, the tray 26 is turned counterclockwise to the horizontal position, thereby enabling the tray 26 to rotate easily. That is, the tilt angle of the tray 26 may be variable.

At the start of operation of the turnabout mechanism 12, the pneumatic cylinder 40 is driven and the tray 26 is turned in such direction as indicated in FIG. 2 or so that the rising wall 30 makes a right angle with the feed direction of the articles 24. Further, the tray 26 may receive the article 24 across the low rising wall 28 then located on the feed mechanism 10 side as shown in FIGS. 1 and 3 by the drive of the inclining pneumatic cylinder 42, and may be so inclined that the received article 24 may move toward the rising wall 30 then located on the slide mechanism 14 side by the action of gravity.

The first article 24 delivered from the feed mechanism 10 is fed on to the tray 26, rolls down the tray 26, and then hits against the rising wall 30 to stop there. A fixed number of articles 24 are delivered from the feed mechanism 10 successively, hit against the first article 24 to line up in the same direction, and stop in regular succession to form layers in which a prescribed number of articles 24 stand in line in the feed direction thereof. At that time, though the articles 24 may not be exactly uniform as regards the longitudinal positions of their respective end faces, their longitudinal directions are all made even or parallel. Such arrangement in which the articles are first put side by side in the feed direction thereof on the tray 26 is called the first alignment.

After the articles 24, subject to such first alignment, are transferred onto the tray 26, the inclining pneumatic cylinder 42 is operated, a piston rod 44 is withdrawn or lowered from the tray 26, and the tray 26 is made level. Subsequently, the pneumatic cylinder 40 is operated, and the pinion 36, rotary shaft 32 and tray 26 are turned through a fixed angle through the rack 38. This is a preliminary operation for supplying the slide mechanism 14 with the articles 24 on the tray 26 by moving them in their longitudinal direction, and such fixed angle may be determined according to the position and direction in which the slide mechanism 14 is located. In this embodiment, the fixed angle is given at 90°. Thus, after the tray 26 is turned through an angle of 90°, the inclining pneumatic cylinder 42 is driven to force up the feed mechanism 10 side of the tray 26. By this action, the tray 26 is inclined from the feed mechanism 10 side to the slide mechanism 14 side with the one side of the tray 26 having no rising walls 28, 29 and 30 located on the slide mechanism 14 side. Thus, the prescribed number of articles 24, kept subject to the first alignment, slide down the tray 26 all together in parallel with one another and are fed to the slide mechanism 14 from left to right as in FIG. 3. The aforesaid prescribed number of articles is to be equal to the number of the articles to be put in a single layer within the packing box 16 as mentioned hereinafter.

Figure 3:
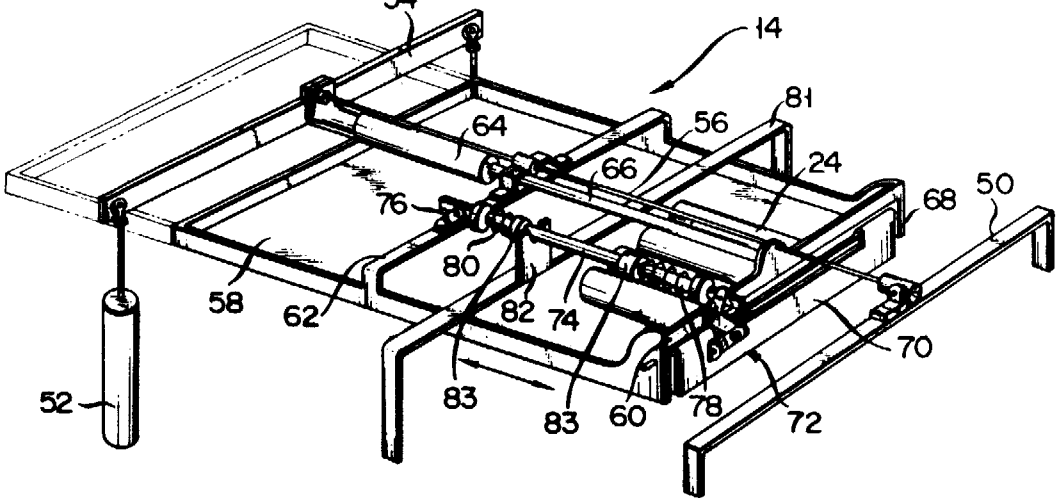
FIG. 3 is a perspective view of the slide mechanism.

The slide mechanism 14 is illustrated in detail in FIG. 3. Numerals 50 and 52 denote a bearing frame and elevating pneumatic cylinders, respectively, attached to the housing (not shown). The cylinders 52 are provided on both sides of an elevating plate 54 for rise and fall of such elevating plate 54. Since one of the cylinders 52, 52 is designed to be capable of taking a different stroke to that of the other cylinder, the elevating plate 54 moves up to various positions corresponding to the combination of the two strokes. FIG. 3 shows only one such cylinder 50 situated on one side of plate 54. Between the bearing frame 50 and the elevating plate 54 is stretched a guide bar 56 pivotally mounted on the bearing frame 50, while a sliding tray 58 is slidably suspended from the guide bar 56. Such suspension of the sliding tray 58 may be realized by passing the guide bar 56 through an end plate 60 of the sliding plate 58 and a suspending plate 62 spanning the middle portion of the sliding tray 58.

A sliding pneumatic cylinder 64 is pivoted to the elevating plate 54, and the tip end of a piston rod 66 cooperating with the pneumatic cylinder 64 is fixed to the end plate 60. Accordingly, the sliding tray 58 moves along the guide bar 56 accompanying the operation of the sliding pneumatic cylinder 64. When the elevating pneumatic cylinders 52, 52 are driven to raise the elevating plate 54, the guide bar 56 and the sliding pneumatic cylinder 64 are inclined to tilt the sliding tray 58. At this time, elevating plate 54 moves upward by substantially the mean length of the strokes given by both cylinders 52, 52. In the end plate 60 there is an opening or outlet for the articles 24 which may be opened and closed by a shutter 70. The shutter 70 is coupled with one end of a link mechanism 72, while the other end thereof is coupled to a portion near the right end of an operating bar 74. On each end of the operating bar 74 is mounted each one end of coil springs 78 and 80, while the other ends thereof are left free. The operating bar 74 is extending through a recess in a stopper plate 82 on a frame 81 mounted on the housing (not shown) lying between the two coil springs 78 and 80. A spacer 83 is mounted on the operating bar 74 between each free end of the springs 78, 80 and the stopper plate 82. When the sliding tray 58 is shifted by the sliding pneumatic cylinder 64, the operating bar 74 is also shifted and either one of the coil springs 78 and 80 hits through the spacer 83 against the stopper plate 82. For example, when the sliding tray 58 moves to the left as in FIG. 3, the coil spring 78 hits through the spacer 83 against the stopper plate 82 to push the operating bar 74 to the right, thereby closing the shutter 70 through the link mechanism 72. On the other hand, when the sliding tray 58 is moved to the right as in FIG. 3, the coil spring 80 hits through the spacer 83 against the stopper plate 82 to push the operating bar 74 to the left, thereby opening the shutter 70 through the link mechanism 72. The timing of the operation of the shutter 72 is adjustable by selecting the spacers 83 of suitable lengths.

When the slide mechanism 14 is to receive the articles 24 from the turnabout mechanism 12, the elevating plate 54 is inclined to the direction opposite to the turnabout mechanism 12 or toward the right as in FIGS. 1 and 3 by action of the elevating pneumatic cylinder 52, while the sliding tray 14 is shifted to the left by action of the sliding pneumatic cylinder 64 as indicated by the imaginary line in FIG. 3. The prescribed number of articles 24, which have been subjected to the first alignment on the tray 26 of the turnabout mechanism 12, slide all at once in the longitudinal direction when the tray 26 is inclined and are transferred on to the sliding tray 58 through the elevating plate 54 side. Then such articles 24 slide down the sliding tray 58 due to the inclination thereof to stop against the shutter 70 on their respective end faces. Thus, the end-face positions of the respective articles 24 may be brought in alignment with one another. Such alignment is called the second alignment. The prescribed number of articles 24, which have been put all together in the same direction in the first alignment and then trued up in the second alignment, are in such an orderly state that they can be fed to the packing box 16.

When the sliding pneumatic cylinder 64 is operated, the piston rod 66 is forced to the right as in FIG. 3 to shift the sliding tray 58 to the right, thereby actuating the shutter 70 to open the outlet 68. Thereafter, when the elevating plate 54 is further raised by operating the elevating pneumatic cylinders 52, 52, the sliding tray 58 is inclined to a substantial degree, and the prescribed number of articles 24, in exact orientation subject to the first and second alignments, slip off the sliding tray 58 to be introduced regularly into the packing box 16 (FIGS. 1 and 4) disposed in the vicinity of the forward end of the sliding tray 58.

Figure 4:
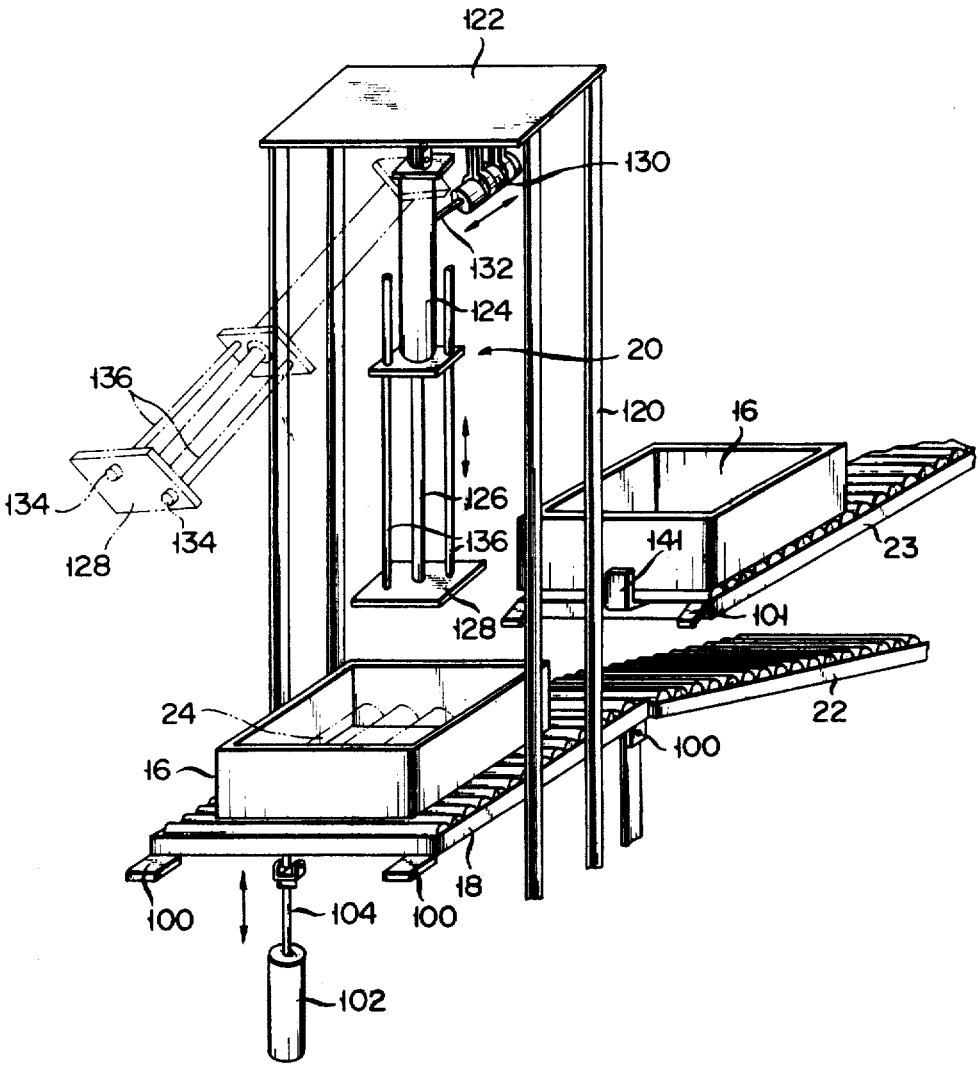
FIG. 4 is a perspective view of the packing box receiver, partition plate feeder, and delivery mechanism.

As shown in FIG. 4, the packing box 14 is placed on the packing box receiver 18. This receiver 18 is a kind of roller conveyor whose one end is supported at the lowest position by stoppers 100 and whose backside is connected to a piston rod 104 which is driven by the pneumatic cylinder 102. At this state, the inclination of the receiver 18 is same as that of the packing box delivery mechanism 22. The packing box 16, however, is prevented from sliding down onto the mechanism 22 by a stopper 106 (FIG. 1) which is driven by a pneumatic cylinder 105. Therefore, when the cylinder 102 is operated, the piston rod 104 and the packing box receiver 18 move up and down. At the uppermost end of the receiver 18, one side of the receiver 18 is stopped by stopper 101 (FIG. 4) and the receiver 18 is inclined at the same angle as the packing box supply mechanism 23. In FIG. 4, the articles 24 are delivered into the packing box 16 from the left. In the vicinity of the right end portion of the receiver 18 is provided the roller-conveyor-type packing box delivery means 22 inclining gradually from the right end portion of the receiver 18. Accordingly, when the pneumatic cylinder 105 is operated, the stopper 106 is released and the packing box 16 is transferred from the receiver 18 to the packing box delivery mechanism 22, thereby delivering the packing box 16 to a predetermined place along the delivery means 22.

When the charged or filled packing box 16 is delivered, the packing box receiver 18 is moved upward, for receiving a empty packing box 16, through the pneumatic cylinder 102 and the piston rod 104, and one empty packing box 16 is supplied to the packing box receiver 18 by the action of the pneumatic cylinder 140 (FIG. 1) and a corresponding link mechanism 141. Then the receiver 18 is moved downward to the position where the receiver 18 is capable of receiving the articles 24.

In order to protect the articles 24 contained within the packing box 16, there may be provided at need the partition plate feeder 20 above the packing box receiver 18. The feeder 20 interposes partition sheets successively between each layer of articles formed by feeding the packing box with the prescribed number of articles 24 and the next layer to be formed on such layer. The partition sheets are to be interposed for preventing the articles in the packing box 16 from being damaged or broken due to direct contact with one another.

Referring to FIG. 4, the partition plate feeder 20 comprises four legs 120 mounted on the housing (not shown) around the packing box receiver 18, a mount 122 placed on the legs 120, a cylinder 124 swingably hung from the mount 122, a piston rod 126 inserted in and vertically driven by the cylinder 124, an adsorption plate 128 attached to the bottom end of the piston rod 126, and a swinging pneumatic cylinder 130 attached to the back of the mount 122. When the swinging pneumatic cylinder 130 is operated, the piston rod 132 is moved to swing the cylinder 124, piston rod 126, and adsorption plate 128. The position indicated by the imaginary line in FIG. 4 illustrates a state in which the cylinder 124 and the other associated parts are shifted to the side in the figure.

On the back of the adsorption plate 128 are provided suction parts 134 which are connected to a suitable vacuum source (not shown) through pipes or hoses 136. When the prescribed number of articles 24 are introduced into the packing box 16 to form a layer of articles, the cylinder 130 is operated to swing the adsorption plate 128 as shown in FIG. 4, and the adsorption plate 128 receives by suction a partition sheet (not shown) made of, e.g., corrugated cardboard which may be stored in the housing case (not shown) and disposed opposite to the adsorption plate 128. Subsequently, when the swinging pneumatic cylinder 130 is operated reversely, the adsorption plate 128 returns to the original position above the packing box 16 retaining the partition sheet thereon by suction. Then the adsorption plate 128 and hence the partition sheet are brought down to the vicinity of the packing box 16 by operating the cylinder 124. When the partition sheet reaches a predetermined position, the vacuum pressure acting on the suction part 134 is removed by a suitable means to drop the partition sheet on to the layer of articles 24 in the packing box 16. Every time the prescribed number of articles 24 are introduced into the packing box 16, the aforesaid process is repeated to interpose a respective partition between the layers, and when the packing box 16 is filled up, it is delivered to the predetermined place by operating the pneumatic cylinder 102.

According to the encasing apparatus of this invention, as described above, each prescribed number of articles 24 to be packed are subjected to the *first alignment* in the turnabout mechanism 12, further subjected to the second alignment in the subsequent side mechanism 14 for the prescribed orientation, and then introduced regularly into the packing box 16. Such first and second alignments, as well as other operations relevant thereto, may be all achieved by mechanical systems without requiring any manual operation, so that the integrated and automatic operation of the above-mentioned mechanisms may contribute to improvement of the efficiency in encasing operations as well as to reduction of cost.

What we claim is:

1. An encasing apparatus for delivering and packing products or articles, hereafter referred to as articles, in a packing box or the like, comprising:

a feed mechanism to feed products or articles to be packed;

a turnabout mechanism located on the forward side in the feed direction of said feed mechanism for making a first alignment of said articles by locating a prescribed number of said articles successively in layers with said articles oriented in a first direction and for delivering said articles, kept subject to said first alignment, in a second direction perpendicular to said first direction after turning said articles through a predetermined angle, said turnabout mechanism including:

a tray having a rising wall along at least one edge thereof;

a vertical rotary shaft;

means for inclinably attaching said tray to the end of said vertical rotary shaft so that said tray turns with said rotary shaft;

means for selectively inclining said tray; and means for driving said rotary shaft to rotate said tray and said articles through said predetermined angle;

a slide mechanism located at the outlet of said turnabout mechanism for receiving said articles and for making a second alignment of said articles to true up the ends of said articles in said second direction of said articles delivered from said turnabout mechanism, said slide mechanism including means for supporting said articles at said ends thereof and exit means for then delivering said articles in said second direction into a packing box; and a packing box support means located adjacent said slide mechanism for supporting a packing box while it is receiving articles from said slide mechanism.

2. An encasing apparatus according to claim 1, wherein said tray comprises a square base plate and has rising walls on two parallel sides of said square base plate.

3. An encasing apparatus according to claim 1, wherein said slide mechanism includes an inclinable sliding tray for receiving at one end thereof articles delivered from said turnabout mechanism and being inclinable to cause said articles to slide down toward the other end side of said sliding tray, said sliding tray having an outlet at said other end side for delivering said articles to said packing box and a shutter to open and close said outlet, said sliding tray making said second alignment of said articles when said shutter is closed and delivering said articles after said second alignment through said outlet when said shutter is opened; means for selectively opening and closing said shutter; and means for selectively inclining said sliding tray.

4. An encasing apparatus according to claim 1 further comprising a partition sheet feeder located above a packing box being packed with articles to interpose a partition sheet between layers of encased articles.

5. An encasing apparatus according to claim 4, wherein said partition sheet feeder comprises a mount located above a packing box being packed, a cylinder swingably hung from said mount, a piston rod cooperatively coupled with said cylinder, an adsorption plate attached to the tip end of said piston rod for receiving and holding at partition sheet, and means attached to said mount for swinging said cylinder.

6. An encasing apparatus according to claim 5, wherein said means attached to said mount for swinging said cylinder swings said cylinder between a partition sheet pick-up position and a partition sheet dropping position above a packing box being packed.

7. An encasing apparatus according to claim 5, wherein said adsorption plate comprises suction means for receiving and holding a partition plate by suction.

8. An encasing apparatus for delivering and packing products or articles, hereafter referred to as articles, in a packing box or the like, comprising:

a feed mechanism to feed products or articles to be packed;

a turnabout mechanism located on the forward side in the feed direction of said feed mechanism and including means for making a first alignment of said articles by locating a prescribed number of said articles successively in layers with said articles oriented in a first direction and means for delivering said articles, kept subject to said first alignment, in a second direction perpendicular to said first direction after turning said articles through a predetermined angle;

a slide mechanism located at the outlet of said turnabout mechanism and including an inclinable sliding tray for receiving at one end thereof articles delivered from said turnabout mechanism and being inclinable to cause said articles to slide down toward the other end side of said sliding tray for making a second alignment of said articles to true up the ends of said articles in said second direction of said articles delivered from said turnabout mechanism, an outlet at said other end side of said sliding tray for delivering said articles in said second direction into a packing box and a shutter to open and close said outlet, said sliding tray making said second alignment of said articles when said shutter is closed and delivering said articles after said second alignment through said outlet when said shutter is opened; means for selectively opening and closing said shutter; and means for selectively inclining said sliding tray; and a packing box support means located adjacent said slide mechanism for supporting a packing box while it is receiving articles from said slide mechanism.

9. An encasing apparatus according to claim 8, wherein said tray comprises a square base plate and has rising walls on two parallel sides of said square base plate.

10. An encasing apparatus according to claim 8 further comprising a partition sheet feeder located above a packing box being packed with articles to interpose a partition sheet between layers of encased articles.

11. An encasing apparatus according to claim 10, wherein said partition sheet feeder comprises a mount located above a packing box being packed, a cylinder swingably hung from said mount, a piston rod cooperatively coupled with said cylinder, an adsorption plate attached to the tip end of said piston rod for receiving and holding at partition sheet, and means attached to said mount for swinging said cylinder.

12. An encasing apparatus according to claim 11, wherein said means attached to said mount for swinging said cylinder swings said cylinder between a partition sheet pick-up position and a partition sheet dropping position above a packing box being packed.

13. An encasing apparatus for delivering and packing products or articles, hereafter referred to as articles, in a packing box or the like, comprising:

a feed mechanism to feed products or articles to be packed;

a turnabout mechanism located on the forward side in the feed direction of said feed mechanism for making a first alignment of said articles by locating a prescribed number of said articles successively in layers with said articles oriented in a first direction and for delivering said articles, kept subject to said first alignment, in a second direction perpendicular to said first direction after turning said articles through a predetermined angle;

a slide mechanism located at the outlet of said turnabout mechanism for receiving said articles and for making a second alignment of said articles to true up the ends of said articles in said second direction of said articles delivered from said turnabout mechanism, said slide mechanism including means for supporting said articles at said ends thereof and exit means for then delivering said articles in said second direction into a packing box;

a packing box support means located adjacent said slide mechanism for supporting a packing box while it is receiving articles from said slide mechanism; and a partition sheet feeder located above a packing box being packed with articles to interpose a partition sheet between layers of encased articles, said partition sheet feeder including a mount located above a packing box being packed, a cylinder swingably hung from said mount, a piston rod cooperatively coupled with said cylinder, an adsorption plate attached to the tip end of said piston rod for receiving and holding at partition sheet, and means attached to said mount for swinging said cylinder.

14. An encasing apparatus according to claim 13 wherein said means attached to said mount for swinging said cylinder swings said cylinder between a partition sheet pick-up position and a partition sheet dropping position above a packing box being packed.

15. An encasing apparatus according to claim 13 wherein said adsorption plate comprises suction means for receiving and holding a partition plate by suction.

* * * * *